United States Patent [19]

Doney

[11] Patent Number: 4,750,232

[45] Date of Patent: Jun. 14, 1988

[54] PORTABLE GOLF BALL WASHER

[76] Inventor: Richard R. Doney, 8989 Olympic Trail, Brighton, Mich. 48166

[21] Appl. No.: 14,227

[22] Filed: Feb. 12, 1987

[51] Int. Cl.[4] ..... A63B 47/04

[52] U.S. Cl. ..... 15/104.92; 15/21 A; 15/210 R; 294/19.2

[58] Field of Search ..... 15/21 A, 97 R, 104.92, 15/210 R, 160 R, 104.94; 269/254 R; 294/19.2, 99.1; 401/9-11

[56] References Cited

U.S. PATENT DOCUMENTS

| | | | |
|---|---|---|---|
| 1,320,633 | 11/1919 | Minkler | 15/21 A |
| 2,204,482 | 6/1940 | Filipiak | 294/19.2 |
| 2,205,345 | 6/1940 | Christensen | 294/19.2 |
| 2,672,637 | 3/1954 | Allen | 15/21 A |
| 3,101,497 | 8/1963 | Derkocz | 15/21 A |
| 3,271,802 | 9/1966 | Thompson | 15/21 A |

*Primary Examiner*—Edward L. Roberts

[57] ABSTRACT

A portable golf ball washer comprising a vertical cylindrical container with one end closed and a cap on the other end for sealing the container when not in use, a piece of bristled carpet in the container which lines the vertical interior surface of the container with the bristled side of the carpet facing inward and forming a cylinder in which a golf ball can be scrubbed, a ball holding and plunging device having one end comprising a handle and the other end comprising two loops of diameter smaller than the diameter of a golf ball which hold a golf ball on opposite sides of the golf ball, but allowing rotation of the golf ball.

16 Claims, 1 Drawing Sheet

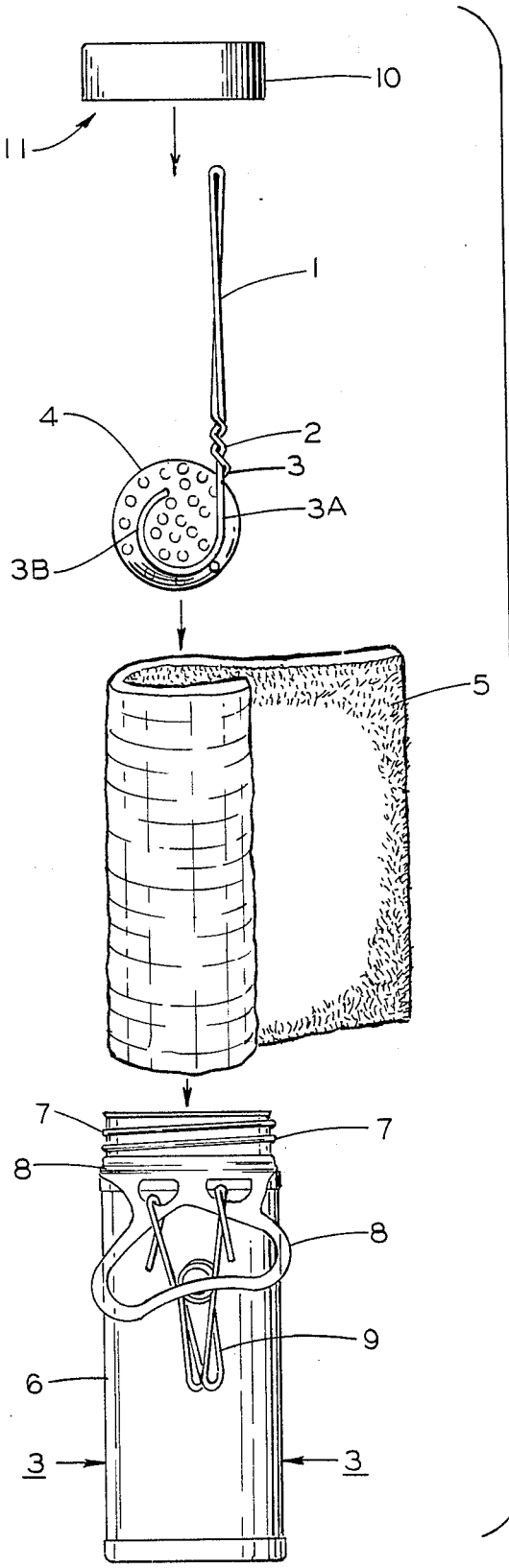
FIG. 1
FIG. 2
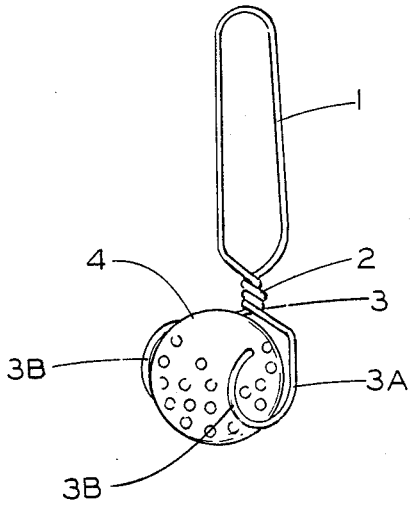
FIG. 3
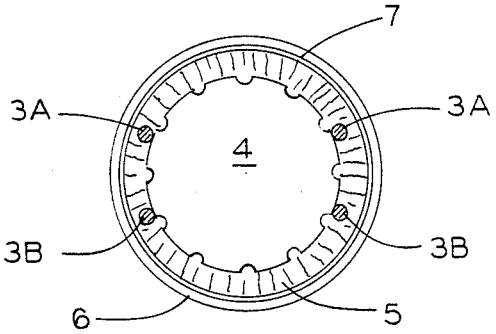

PORTABLE GOLF BALL WASHER

BACKGROUND OF INVENTION

Numerous devices are known in the art for the general purpose of golf ball washing. Many golf courses provide stationary golf ball washers at the tees of several holes. Recognizing the need for a golf ball washer at other locations on the golf course and off, several portable golf ball washers are known in the art. Prior to the present invention, however, no portable golf ball washer in the art has provided means which adequately satisfy all of the most important characteristics needed in a portable golf ball washer, those being an adequate device for retaining the ball, an adequate scrubbing means, a container capable of sealing to prevent spillage and evaporation of cleaning liquid, and an adequate means of attaching the golf ball washer to a golf bag or cart.

SUMMARY OF INVENTION

It is a primary object of the present invention to provide a portable golf ball washer which may effectively be carried and used at all times when the user may wish to clean a golf ball.

It is a further object of the invention to provide a portable golf ball washer which seals sufficiently when not in use to prevent the spillage or evaporation of cleaning fluids.

It is a further object of the invention to provide a portable golf ball washer which can easily hang from, attach to, or be carried in a golf bag or cart.

It is a further object of the invention to provide a portable golf ball washer which satisfactorily scrubs the golf ball to properly cleanse it of foreign material.

It is a further object of the invention to provide a portable golf ball washer which includes a satisfactory means of holding the golf ball while being cleaned in the scrubbing portion of the invention such that the holding means will hold the golf ball without contact or insertion into the scrubbing receptacle and will allow rotation of the golf ball to permit scrubbing of the entire surface area of the ball.

It is a further object of the invention to provide a portable golf ball washer which is inexpensive, long lasting and reliable in operation.

Further details and objects of the invention will be more particular and additionally set forth in the following drawings, detailed description of the embodiment and claims.

DESCRIPTION OF THE DRAWINGS

FIG. 1 is an assembly view of all the components of the present invention, which include, from top to bottom, a cap to the container, a golf ball holding instrument for plunging the golf ball into the container, scrubbing means to be inserted into the container so that it will scrub the golf ball when plunged into the container, and the container with attached carrying strap and clasp.

FIG. 2 is a perspective view of the golf ball holding instrument.

FIG. 3 is a top cross sectional view from FIG. 1 as the invention would appear assembled.

DESCRIPTION OF PREFERRED EMBODIMENT

Referring to FIG. 1, the portable golf ball washer comprising the present invention consists of a cylindrical container 6 with integrally molded grooves 7 for connection to a cap 10 which has integrally molded grooves 11 compatible with those of the container 6. Inside the container 6 is inserted a scrubbing means 5 such as a fitted piece of grass carpet or other bristled material which can be rolled into a cylinder with the bristled surface inward and inserted into the container 6. The golf ball holding instrument consisting of components 1, 2, 3, 3A and 3B, comprises a stiff wire made of a non-rusting material such as aluminum to prevent staining of the golf ball with rust and coated with a non-rusting polymer material which reduces friction between the golf ball holding instrument and the golf ball, the golf ball holding instrument being formed into a shape which includes a handle 1, a sprial of the wire 2 and a golf ball holding means 3, the golf ball holding means having sub-components 3A and 3B. A golf ball 4 is pictured to assist in the understanding of the invention's operation. Attached to the container 6 is a carrying strap 8 which comprises a flexible plastic band with two integrally molded loops, one of which fits firmly around the neck of the container 6. The other loop of the carrying strap 8 allows hanging and carrying of the invention. Finally, attached through integrally molded holes in the carrying strap 8 is a clasp 9 which comprises a stiff wire coated with a rust free material and formed into a "clothespin" style clasp, the clasp 9 allowing an alternative means for carrying the invention by clasping the invention to other golf accessories.

FIG. 2 is a perspective view of the golf ball holding instrument showing a portion of both sides of the two-loop design for holding the golf ball 4 in such a way as to allow easy insertion, retention, removal and rotation of the golf ball 4 in the golf ball holding instrument. The golf ball holding instrument is formed into a shape which includes an elongated loop 1 to function as a handle allowing the insertion of a finger through the loop 1 for easy holding and manipulation of the golf ball holding instrument and the golf ball 4. The golf ball holding instrument further comprises a spiral 2 of the stiff wire which provides a firm connection between the handle 1 and the golf ball holding means 3. The golf ball holding instrument further comprises a golf ball holding means 3. The golf ball holding means 3 comprises two loops formed in parallel planes attached to the spiral 2 by a continuation of the wire which extends in opposite directions from the spiral 2, each loop being a continuation of the wire from the respective extentions from the spiral 2. The loops are a distance apart of approximately 90% of the diameter of the golf ball 4. Each loop forms approximately 80% of a circle which has a diameter of approximately 70% of the diameter of the golf ball 4. The distance that the loops are apart, the degree to which each loop forms a circle and the diameter of the circles formed by the loops can vary substantially from the estimates expressed, and such variations are contemplated by the present invention. The wire used is of sufficient flexibility to allow the temporary expansion of the distance between the loops to accommodate the insertion and removal of the golf ball 4, but of sufficient resilience to return the loops to their original distance apart and thereby retain the golf ball 4 once the golf ball 4 has been inserted into the golf ball holding means 3.

FIG. 3 is a cross-sectional view from FIG. 1 as the invention would appear assembled with the scrubbing means 5, the golf ball holding means 3 and the golf ball 4 inserted into the container 6. FIG. 3 shows the manner in which the ball holding means 3 retains the golf ball 4 by trapping the golf ball 4 within the rear portions 3A and the forward portions 3B of the golf ball holding means 3.

The preferred embodiment of the portable golf ball washing apparatus comprising the present invention comprises a golf ball holding instrument which comprises a golf ball holding means consisting of at least two loops, said loops encircling at least 180 degrees, the curvature of said loops being equivalent to the curvature of any circle with a diameter smaller than the diameter of a golf ball, and said golf ball holding means being joined to a handle means; and a golf ball cleaning means consisting of a receptacle containing scrubbing means into which the golf ball holding instrument can be inserted and repetitiously plunged for the purpose of cleaning golf balls held by the golf ball holding instrument. The preferred embodiment further comprises the golf ball holding means consisting at least in part of a non-rusting material and wherein the cleaning means further comprises a cleaning fluid retained in the receptacle and wherein the cleaning means further comprises a means for capping the receptacle to prevent spillage and evaporation of a cleaning fluid and wherein the apparatus further comprises an attaching means selected from the group of a loop attached to and extending from the apparatus and a clasping means attached to and extending from the apparatus.

What is claimed is:

1. A portable golf ball washing apparatus comprising:

a. A golf ball holding instrument comprising a golf ball holding means consisting of at least two loops, said loops being spatially fixed with relation to one another, said loops encircling at least 180 degrees within respective parallel planes, said loops being a fixed distance apart greater than one-quarter inch and less than the diameter of a golf ball, said loops comprising a material of sufficient resilience to return to their fixed spatial relationship after the physical expansion of the distance between the loops during the insertion or retraction of a golf ball, the curvature of said loops being equivalent to the curvature of any circle with a diameter smaller than the diameter of a golf ball, and said golf ball holding means being joined to a handle means, said handle means being spatially fixed in relation to said loops; and b. a golf ball cleaning means consisting of a receptacle containing scrubbing means into which the golf ball holding instrument can be inserted and repetitiously plunged for the purpose of cleaning golf balls held by the golf ball holding instrument.

2. The apparatus of claim 1 wherein the golf ball holding means consists at least in part of a non-rusting material.

3. The apparatus of claim 1 wherein the golf ball holding means consists at least in part of a non-rusting material and wherein the golf ball cleaning means further comprises a cleaning fluid retained in the receptacle.

4. The apparatus of claim 1 wherein the golf ball cleaning means further comprises a cleaning fluid retained in the receptacle.

5. The apparatus of claim 1 wherein the golf ball holding means consists at least in part of a non-rusting material and wherein the golf ball cleaning means further comprises a cleaning fluid retained in the receptacle and wherein the golf ball cleaning means further comprises a means for capping the receptacle to prevent spillage and evaporation of a cleaning fluid.

6. The apparatus of claim 1 wherein the golf ball holding means consists at least in part of a non-rusting material and wherein the golf ball cleaning means further comprises a means for capping the receptacle to prevent spillage and evaporation of the cleaning fluid.

7. The apparatus of claim 1 wherein the golf ball cleaning means further comprises a means for capping the receptacle to prevent spillage and evaporation of a cleaning fluid.

8. The apparatus of claim 1 wherein the golf ball cleaning means further comprises a cleaning fluid retained in the receptacle and wherein the golf ball cleaning means further comprises a means for capping the receptacle to prevent spillage and evaporation of a cleaning fluid.

9. The apparatus of claim 1 wherein the golf ball holding means consists at least in part of a non-rusting material and wherein the golf ball cleaning means further comprises a cleaning fluid retained in the receptacle and wherein the golf ball cleaning means further comprises a means for capping the receptacle to prevent spillage and evaporation of a cleaning fluid and wherein the apparatus further comprises an attaching means selected from the group of a loop attached to and extending from the apparatus and a clasping means attached to and extending from the apparatus.

10. The apparatus of claim 1 wherein the golf ball cleaning means further comprises a cleaning fluid retained in the receptacle and wherein the golf ball cleaning means further comprises a means for capping the receptacle to prevent spillage and evaporation of a cleaning fluid and wherein the apparatus further comprises an attaching means selected from the group of a loop attached to and extending from the apparatus and a clasping means attached to and extending from the apparatus.

11. The apparatus of claim 1 wherein the golf ball cleaning means further comprises a means for capping the receptacle to prevent spillage and evaporation of a cleaning fluid and wherein the apparatus further comprises an attaching means selected from the group of a loop attached to and extending from the apparatus and a clasping means attached to and extending from the apparatus.

12. The apparatus of claim 1 wherein the apparatus further comprises an attaching means selected from the group of a loop attached to and extending from the apparatus and a clasping means attached to and extending from the apparatus.

13. The apparatus of claim 1 wherein the golf ball holding means consists at least in part of a non-rusting material and wherein the golf ball cleaning means further comprises a means of capping the receptacle to prevent spillage and evaporation of a cleaning fluid and wherein the apparatus further comprises an attaching means selected from the group of a loop attached to and extending from the apparatus and a clasping means attached to and extending from the apparatus.

14. The apparatus of claim 1 wherein the golf ball holding means consists at least in part of a non-rusting material and wherein the apparatus further comprises an attaching means selected from the group of a loop attached to and extending from the apparatus and a clasping means attached to and extending from the apparatus.

15. The apparatus of claim 1 wherein the golf ball holding means consists at least in part of a non-rusting material and wherein the golf ball cleaning means further comprises a cleaning fluid retained in the receptacle and wherein the apparatus further comprises an attached means selected from the group of a loop attached to and extending from the apparatus and a clasping means attached to and extending from the apparatus.

16. The apparatus of claim 1 wherein the golf ball cleaning means further comprises a cleaning fluid retained in the receptacle and wherein the apparatus further comprises an attachment means selected from the group of a loop attached to and extending from the apparatus and a clasping means attached to and extending from the apparatus.

* * * * *